US007050021B2

(12) United States Patent
Hashimoto

(10) Patent No.: US 7,050,021 B2
(45) Date of Patent: May 23, 2006

(54) METHOD AND APPARATUS TO PROVIDE A HIGH DEFINITION DISPLAY WITH A DISPLAY LINE PITCH SMALLER THAN A CELL ARRANGEMENT PITCH IN THE COLUMN DIRECTION

(75) Inventor: Yasunobu Hashimoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 254 days.

(21) Appl. No.: 09/778,919

(22) Filed: Feb. 8, 2001

(65) Prior Publication Data

US 2001/0040539 A1 Nov. 15, 2001

(30) Foreign Application Priority Data

Apr. 7, 2000 (JP) ..... 2000-105897

(51) Int. Cl.
*G09G 3/28* (2006.01)

(52) U.S. Cl. ..... 345/63; 345/690; 315/169.4

(58) Field of Classification Search ..... 345/60, 345/63, 66, 67, 690; 313/582–587; 315/169.4, 315/169.1

See application file for complete search history.

(56) References Cited

U.S. PATENT DOCUMENTS

| | | | | |
|---|---|---|---|---|
| 4,745,406 | A | 5/1988 | Hayashi et al. | |
| 5,579,027 | A * | 11/1996 | Sakurai et al. | 345/100 |
| 5,659,226 | A * | 8/1997 | Shigeta | 313/491 |
| 5,825,128 | A * | 10/1998 | Betsui et al. | 313/582 |
| 5,982,347 | A * | 11/1999 | Shigeta et al. | 345/88 |
| 6,376,986 | B1 * | 4/2002 | Takagi et al. | 313/582 |

FOREIGN PATENT DOCUMENTS

| | | |
|---|---|---|
| JP | 50-114119 | 9/1975 |
| JP | 05-216433 | 8/1993 |
| JP | 06-195038 | 7/1994 |
| JP | 9-050768 | 2/1997 |
| JP | 9-160525 | 6/1997 |
| JP | 2000-011894 | 1/2000 |
| JP | 2000-502813 | 3/2000 |
| WO | WO 97/23861 | 7/1997 |

OTHER PUBLICATIONS

Sano y et al: "A Full-Color Surface-Discharge AC Plasma TV Display" Sid International Symposium Digest of Technical Papers. Anaheim, May 6, vol. vol. 22, May 6, 1991, pp. 728-731, XP000503118 ISSN: 0097-966X.

Japanese Communication for Japanese Application No. 2000-105897 dated Jul. 5, 2005.

Prior Art Information List (Concise Explanation of the Relevance).

* cited by examiner

*Primary Examiner*—Amr A. Awad
(74) *Attorney, Agent, or Firm*—Staas & Halsey LLP

(57) ABSTRACT

A high definition display having a display line pitch smaller than a cell arrangement pitch in the column direction is provided. A display device to be used has a display surface including plural cell columns, each of which is a set of cells having the same light emission color. The display device has a cell arrangement structure in which cell positions in the column direction are shifted from each other between the neighboring cell columns. An interlaced display is performed by changing the combination of cells of a display line that is perpendicular to the column direction in every field between the neighboring cell columns of the same light emission color.

15 Claims, 10 Drawing Sheets

[Type A]

[Type B]

METHOD AND APPARATUS TO PROVIDE A HIGH DEFINITION DISPLAY WITH A DISPLAY LINE PITCH SMALLER THAN A CELL ARRANGEMENT PITCH IN THE COLUMN DIRECTION

BACKGROUND OF THE INVENTION

1. Field of the Invention

The present invention relates to a method and an apparatus for displaying an image, which are suitable especially for a display using a plasma display panel (PDP).

As a television display device having a large screen, an AC type PDP of a surface discharge format is commercialized. The surface discharge format has first and second display electrodes each of which serves as an anode or a cathode in a display discharge for ensuring a luminance arranged in parallel on a front or a back substrate.

As an electrode matrix structure of the surface discharge type PDP, a "three-electrode structure" is widely known, in which an address electrode is arranged so as to cross the display electrode pair. For the display, one of the display electrodes (the second display electrode) is used as a scanning electrode for selecting a display line, and an address discharge is generated between the scanning electrode and the address electrode so as to control the wall charge in accordance with the content of the display for addressing. After the addressing, a sustaining voltage having an alternating polarity is applied to the display electrodes, so that a surface discharge is generated only in the cell having a predetermined wall charge along the substrate surface.

In a surface discharge type PDP, a partition (a barrier rib) for dividing a discharge space into columns is necessary. Concerning a partition structure, a stripe structure in which a partition having a banding shape in the plan view is arranged (including a structure in which a stripe pattern layer and a mesh pattern layer are overlaid) has an advantage over a mesh (waffle) structure in which each cell is separated from others. In the stripe structure, the discharge space of each column is continuous over the entire length of the screen, so that a discharge probability is increased by a priming effect, and that a fluorescent material layer can be arranged uniformly and easily, and that an air exhaustion process can be shortened.

2. Description of the Prior Art

A three-electrode surface discharge type PDP that is disclosed in Japanese unexamined patent publication No. 9-160525 is used for an interlaced display. In this PDP, display electrodes are arranged at a constant pitch so as to be connected with all columns that are defined by linear banding partitions, and the number of the display electrodes equals to the number N of the display line in the screen plus one. Among the (N+1) display electrodes, two neighboring display electrodes constitute an electrode pair for generating a surface discharge and define one display line (row) of the screen. Each of the display electrodes except for both ends of the arrangement works for two display lines (an odd display line and an even display line), while each of the end display electrodes works for one display line. Thus, the PDP, wherein all display electrode gaps are made discharge gaps and one display electrode is shared by two display lines for discharge, has an advantage in that the resolution (the number of display lines) is substantially doubled, and that there is no non-light emission area between the display lines so that each cell a large aperture ratio, compared with a PDP in which a pair of display electrodes is arranged for each display line.

In Japanese unexamined patent publication No. 9-50768, a three-electrode surface discharge type PDP having a modified stripe partition structure is proposed in which a meandering band-like partition is used for dividing the discharge space, so as to prevent discharge interference (cross talk) in the column direction. Each partition meanders so as to form a column space having alternating widened portions and narrowed portions in cooperation with the neighboring partition. The position of the widened portion in which a cell is formed is shifted from that of the neighboring column, so that the arrangement of three colors for a color display becomes Delta Tricolor Arrangement. In the conventional image display using this PDP, each display line is made of cells including a fixed cell selected for each column.

In the conventional image display using the delta arrangement PDP, the display line pitch equals to the cell arrangement pitch in the column direction, so there is a problem in that it is necessary to reduce the cell size in order to improve the resolution in the column direction.

SUMMARY OF THE INVENTION

An object of the present invention is to provide a high definition display having a display line pitch smaller than a cell arrangement pitch in the column direction in the display surface in which cells of a display line are arranged zigzag.

According to a first aspect of the present invention, a method of displaying an image is provided. The method comprises the steps of using a display device having a display surface including plural cell columns each of which is a set of cells having the same light emission color, the display device having a cell arrangement structure in which cell positions in the column direction are shifted from each other between the neighboring cell columns, and performing an interlaced display by changing the combination of cells of a display line that is perpendicular to the column direction in every field between the neighboring cell columns of the same light emission color.

According to a second aspect of the present invention, the method further comprises the step of determining luminance of each cell of the display surface by distributing a luminance value of each pixel of an input image to be displayed to cells corresponding to pixels in accordance with the cell position relationship between a virtual display surface having a cell arrangement corresponding to a pixel arrangement of the input image and the display surface.

According to a third aspect of the present invention, a display apparatus is provided. The apparatus comprises a display device having a display surface including plural cell columns each of which is a set of cells having the same light emission color, the display device having a cell arrangement structure in which cell positions in the column direction are shifted from each other between the neighboring cell columns, and a driving circuit for performing an interlaced display by changing the combination of cells of a display line that is perpendicular to the column direction in every field between the neighboring cell columns of the same light emission color in every field.

According to a fourth aspect of the present invention, the display apparatus has the structure in which the cells are arranged at a constant pitch in each cell column and the shift quantity of the cell position in the column direction between the neighboring cell columns of the same light emission color is a half of the cell arrangement pitch.

According to a fifth aspect of the present invention, the display apparatus has the structure in which luminance of each cell of the display surface is determined by distributing a luminance value of each pixel of an input image to be displayed to cells corresponding to pixels in accordance with the cell position relationship between a virtual display surface having a cell arrangement corresponding to a pixel arrangement of the input image and the display surface.

According to a sixth aspect of the present invention, the display apparatus has the structure in which the all cells within the display surface have the same light emission color.

According to a seventh aspect of the present invention, the display apparatus has the structure in which the display surface includes three kinds of cell columns having different light emission colors, and the color arrangement has a pattern in which three colors are repeated in a constant order.

According to an eighth aspect of the present invention, the display apparatus has the structure in which an interlaced image to be displayed is inputted, and the direction of the display line is the direction of a scanning line of the interlaced image.

According to a ninth aspect of the present invention, the display apparatus has the structure in which a non-interlaced image to be displayed is inputted, and the non-interlaced image is converted into an interlaced image to be displayed.

According to a tenth aspect of the present invention, the display apparatus has the structure in which gradation data of each pixel of the interlaced image are generated from the non-interlaced image data.

According to an eleventh aspect of the present invention, the display apparatus includes a plasma display panel as the display device.

According to a twelfth aspect of the present invention, the display device is a plasma display panel having an inner structure including a partition for dividing a discharge space for each cell column, the discharge space is continuous over the entire length of the display surface in each cell column, and wide portions and narrow portions are arranged alternately so that the narrow portion is located at the boundary position between cells.

According to a thirteenth aspect of the present invention, the display device has a plurality of scanning electrodes arranged to straddle over all cell columns for selecting one cell in each cell column of each field.

DESCRIPTION OF THE PREFERRED EMBODIMENTS

Hereinafter, the present invention will be explained more in detail with reference to embodiments and drawings.

[Structure of the Display Apparatus]

Figure 1:
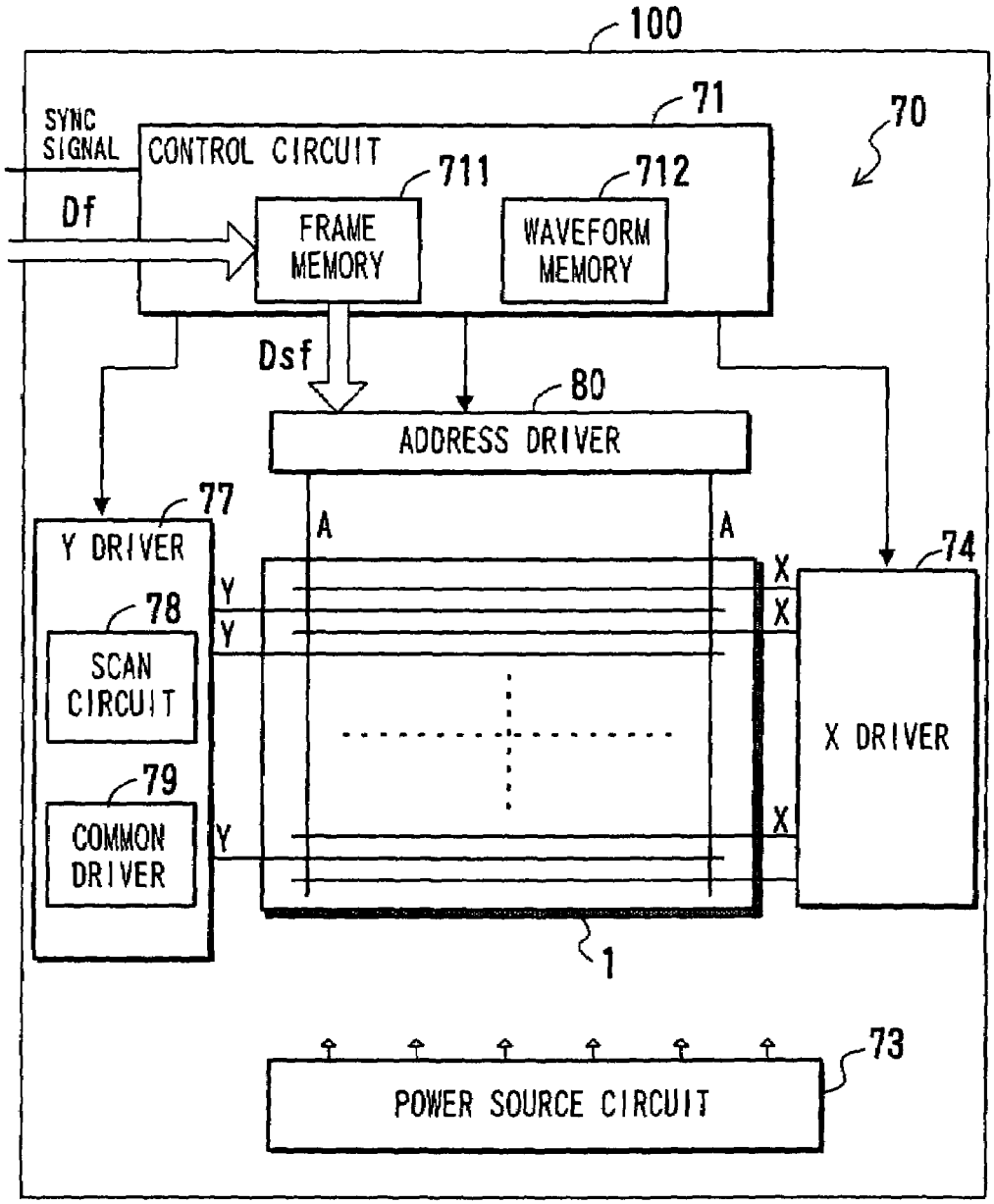
FIG. 1 is a block diagram of a display apparatus according to the present invention.

FIG. 1 is a block diagram of a display apparatus according to the present invention. The display apparatus 100 comprises a three-electrode surface discharge type PDP 1 and a drive unit 70 for selectively activating a cell arranged in a matrix to emit light. The display apparatus 100 is used as a wall-hung TV set or a monitor display of a computer system.

The PDP 1 has a display electrode X and a display electrode Y extending in the display line direction (i.e., in the horizontal direction). The display electrode Y is used as a scanning electrode for addressing. The address electrode A extends in the column direction (in the vertical direction).

The drive unit 70 includes a control circuit 71 for a drive control, a power source circuit 73, an X driver 74, a Y driver 77, and an address driver 80. The drive unit 70 is supplied with frame data Df that are multivalued image data indicating luminance levels of red, green and blue colors along with various synchronizing signals from external equipment such as a TV tuner or a computer. The control circuit 71 includes a frame memory 711 for memorizing the frame data Df temporarily and a waveform memory 712 for memorizing control data of drive voltages. As known widely, a display using a PDP reproduces gradation by controlling lighting in a binary manner. Therefore, each of sequential frames of an input image or a field of the frame (when the input image is an interlace format) is divided into plural subfield. A subfield period that is assigned to each subfield includes a preparation period for equalize a charge distribution of the display surface, an address period for forming a charge distribution corresponding to a display content, and a sustaining period for generating a display discharge for ensuring a luminance level corresponding to a gradation level. In the preparation period, a ramp pulse is applied to adjust a wall voltage to a desired value, for example. In the address period, a scan pulse is applied to the display electrode Y for selecting a display line, and, in synchronization with that, the potential of the address electrode A is controlled in binary manner for addressing. In the sustaining period, a sustaining pulse is applied to the display electrode Y and the display electrode X alternately. A peak value of the sustaining pulse is lower than a discharge start voltage between the display electrodes, so the surface discharge does not occur without the wall voltage being added. Only the lighted cell in which the wall charge was formed during the address period can generate a surface discharge as the display discharge at every application of the sustaining pulse.

The frame data Df are stored in the frame memory 711 temporarily and then are converted into subfield data Dsf for the gradation display, which are transferred to the address driver 80. The subfield data Dsf are display data made of q bits corresponding to q subfields (a set of display data for q screens in which one bit indicates one subpixel), and the subfield is a binary image. The value of each bit of the subfield data Dsf indicates whether the subpixel of the corresponding subfield is to be lighted or not, more accurately, whether it requires the address discharge or not.

The X driver 74 controls the potential of all display electrodes X as a whole. The Y driver 77 includes a scan circuit 78 for addressing and a common driver 79 for sustaining. The scan circuit 78 is means for applying a scan pulse to select a display line. The address driver 80 controls potentials of M address electrodes A in accordance with the subfield data Dsf. These drivers are supplied with a predetermined power via wiring conductors (not shown) from the power source circuit 73.

[Structure of the Display Surface]

Figure 2:
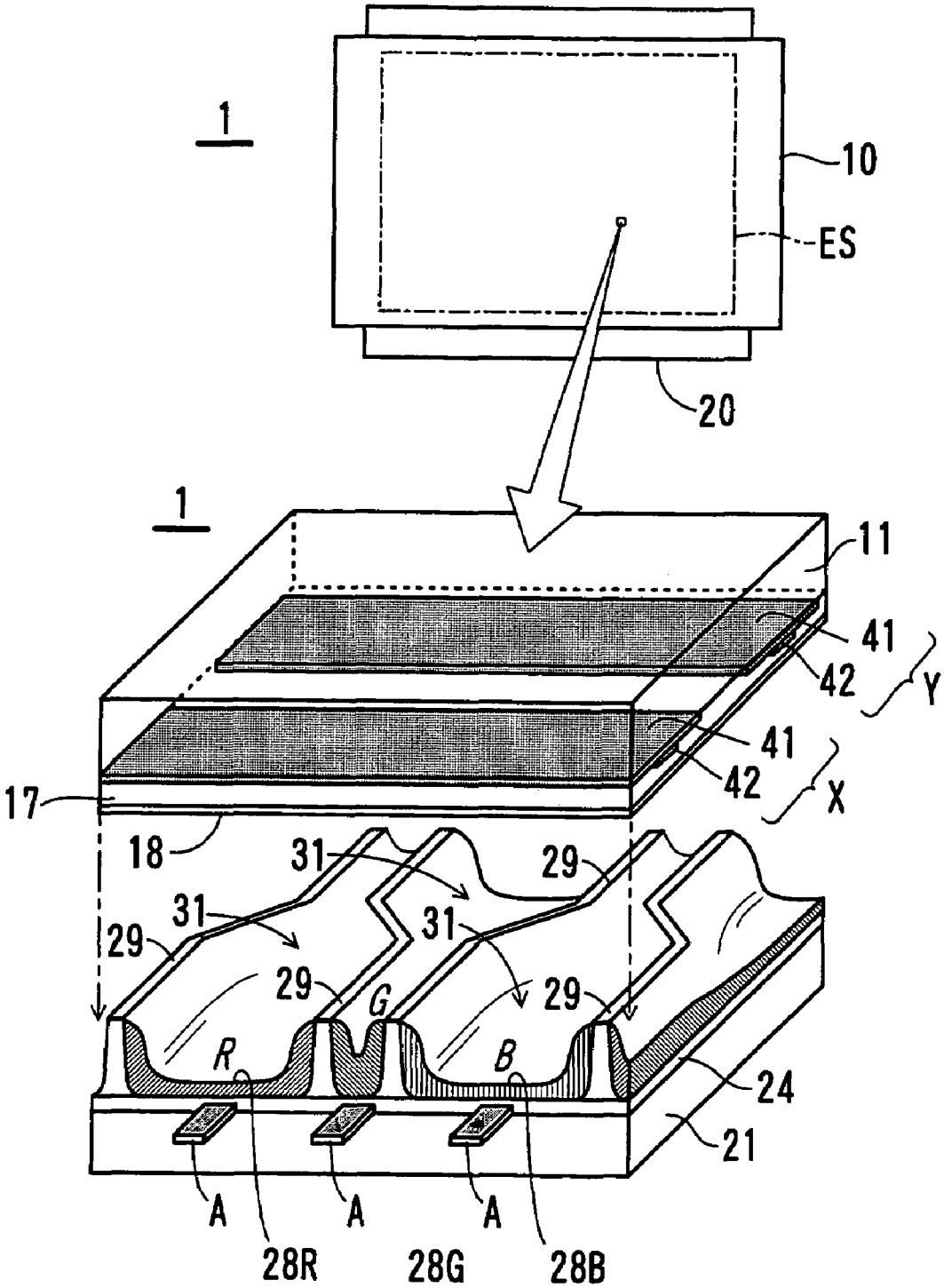
FIG. 2 is a diagram showing a cell structure of a PDP according to the present invention.
Figure 3:
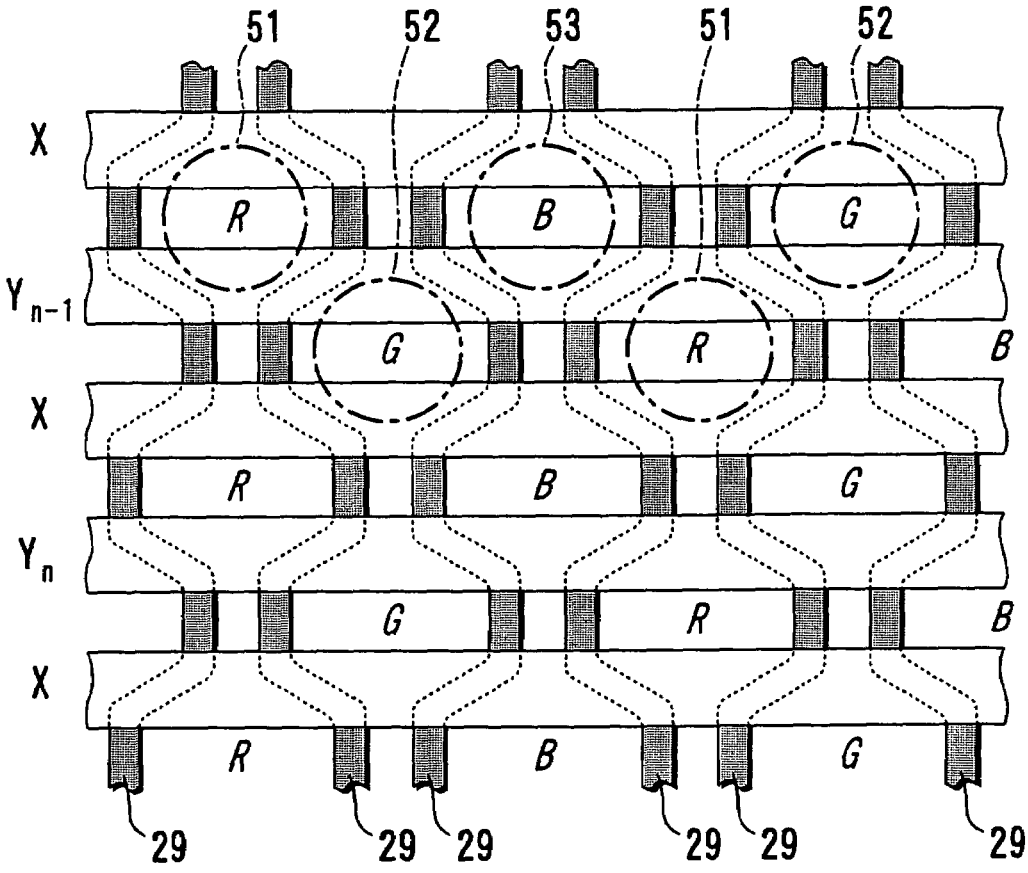
FIG. 3 is a plan view showing a cell arrangement structure.

FIG. 2 is a diagram showing a cell structure of a PDP according to the present invention. FIG. 3 is a plan view showing a cell arrangement structure. In FIG. 2, the inner structure is shown by drawing a pair of substrate structures in a separated state. In FIG. 3, the display electrode Y, whose potential can be controlled individually, is denoted by the reference character "Y" with a suffix indicating an arrangement order.

The PDP 1 includes a pair of substrate structures (each substrate structure has a substrate on which elements of discharge cells are arranged) 10 and 20. The display electrodes X and Y are arranged on the inner surface of the front glass substrate 11. Each of the display electrodes X and Y includes a transparent conductive film 41 for forming a surface discharge gap and a metal film (a bus electrode) 42 extending in the horizontal direction over the entire length of the display surface ES. The display electrodes X and Y are coated with a dielectric layer 17, which is coated with magnesia (MgO) as a protection film 18. The address electrode A is arranged on the inner surface of the back glass substrate 21 and covered with a dielectric layer 24. On the dielectric layer 24, meandering band-like partitions 29 each having a height of approximately 150 μm are arranged for dividing the discharge space into columns. A column space 31 of the discharge space corresponding to each column is continuous over all display lines. The back inner surface and the side face of the partition 29 are covered with fluorescent material layers 28R, 28G and 28B of red, green and blue colors for a color display. Italic letters R, G and B in the figure denote light emission colors of fluorescent materials (ditto for the following figures). The color arrangement of red, blue and green pattern is repeated. The fluorescent material layers 28R, 28G and 28B are excited locally by ultraviolet rays generated by the discharge gas and emit light.

As shown in FIG. 3, the neighboring partitions form a column space 31 including wide portions and narrow portions that are alternating. The position of the wide portion in the column direction is shifted from that of the neighboring column by one-half of a cell pitch in the column direction. A cell as a display element is formed in each wide portion. Cells 51, 52 and 53 of one line are indicated by chain-lined circle as representatives in the figure. The display line is a set of cells that are lighted for displaying a line having the minimum width in the horizontal direction. The cells 51, 52 and 53 of three columns are used for reproduce a color of a pixel of an input image.

[Method of Displaying an Image]

EXAMPLE 1

Figure 4A:
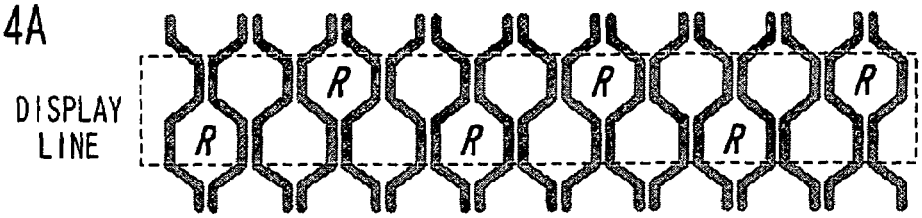
FIGS. 4A and 4B show a layout in which the relationship between positions of cells having the same light emission color of one display line is indicated.
Figure 4B:
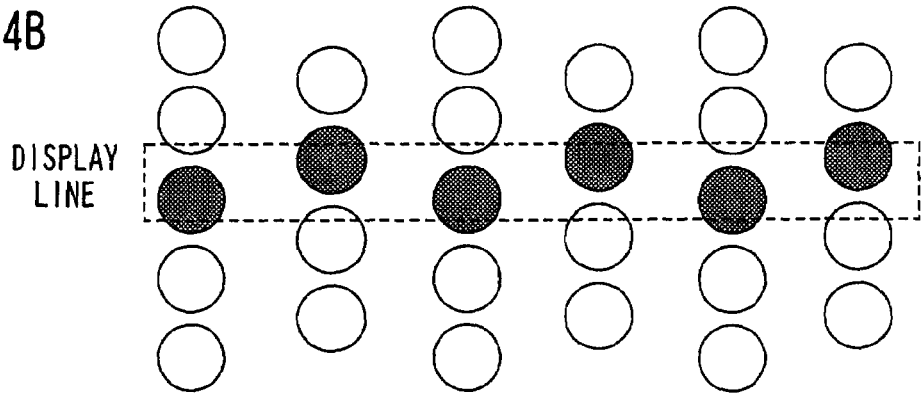
Figure 5:
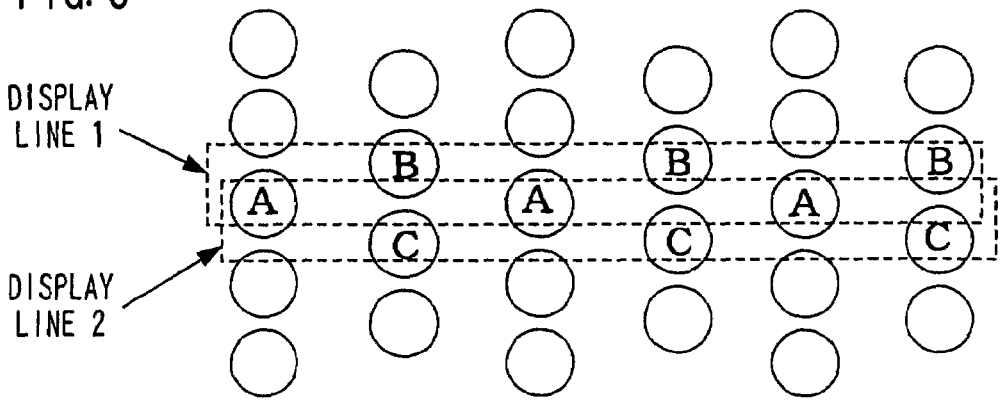
FIG. 5 shows a set of display lines according to the present invention.

FIGS. 4A and 4B show a layout in which the relationship between positions of cells having the same light emission color of one display line is indicated. FIG. 5 shows a set of display lines according to the present invention.

Referring to the display surface cell arrangement, it is understood that a resolution in the column direction can be improved by utilizing the characteristic that the cell position in the column direction is shifted from that of the neighboring column. It is because display lines that are shifted from each other by half a pitch by changing the combination of cells. As shown in FIG. 5, the position of the display line 1 including the cell A and the cell B is shifted from the position of the display line 2 including the cell A and the cell C by half a pitch.

Therefore, when the structure of the display line 1 is adopted for even fields, and when the structure of the display line 2 is adopted for odd fields, the display line is shifted by half a pitch for every field, so that an interlaced display of image information having a display line number that is twice the scanning electrode number.

Hereinafter, a concrete example of the relationship between information of the interlaced image and cells will be explained.

It is supposed that a gradation level of a cell of a certain color is $C_{n,m}$. The suffix n denotes the position in the vertical direction, and the suffix m denotes the position in the horizontal direction, as defined in FIGS. 6 and 7. It should be noted that the numbering of the position depends on the color. The position in the vertical direction of the odd cell in the horizontal direction is shifted from that of the even cell by half a cell pitch in the vertical direction (a pitch of the scanning electrode in this example). The interlaced image signal corresponding to the cell of the noted color is denoted by $T_{n,m}$. The signal of an even field is denoted by $T_{2n,m}$ while the signal of an odd field is denoted by $T_{2n+1,m}$.

The cells having vertical positions of 2n and 2n+1 are assigned to the same display line (horizontal line) for an even field, while the cells having vertical positions of 2n and 2n−1 are assigned to the same display line for an odd field. The relationship between the gradation level and the signal for the red or blue light emission color is defined by the following equations.

(Image 1)

$$\left.\begin{array}{l} C_{2n,2m} = T_{2n,2m} \\ C_{2n+1,2m+1} = T_{2n,2m+1} \end{array}\right\} \text{(for an even field) (1)}$$

$$\left.\begin{array}{l} C_{2n-1,2m+1} = T_{2n-1,2m+1} \\ C_{2n,2m} = T_{2n-1,2m} \end{array}\right\} \text{(for an odd field) (2)}$$

The relationship between the gradation level and the signal for the green light emission color is defined by the following equations.

(Image 2)

$$\left.\begin{array}{l} C_{2n,2m+1} = T_{2n,2m+1} \\ C_{2n+1,2m} = T_{2n,2m} \end{array}\right\} \text{(for an even field) (3)}$$

$$\left.\begin{array}{l} C_{2n-1,2m+1} = T_{2n-1,2m} \\ C_{2n,2m+1} = T_{2n-1,m+1} \end{array}\right\} \text{(for an odd field) (4)}$$

Supposing that the vertical positions of the cells that can be addressed by the n-th scanning electrode are 2n and 2n+1, one line of the image signal corresponds to one scanning electrode as-is for an even field. Therefore, address data (subfield data) can be generated in the order of the image signal. However, concerning an odd field, one line of the image signal straddles two scanning electrodes. Therefore, address data corresponding to one scanning electrode are generated in accordance with the data of the image signal that is shifted in the vertical direction by a line depending on which the horizontal position is even or odd. The image data $S_{n,m}$ of the cell corresponding to the n-th scanning electrode for a cell having the red or blue light emission color are defined by the following equations.

(Image 3)

$$S_{n,m} = T_{2n,m} \quad \text{(for an even field) (5)}$$

$$\left.\begin{aligned} S_{n,2m} &= T_{2n-1,2m} \\ S_{n,2m+1} &= T_{2n+1,2m+1} \end{aligned}\right\} \text{(for an odd field) (6)}$$

The image data $S_{n,m}$ of the cell corresponding to the n-th scanning electrode for a cell having the green light emission color are defined by the following equations.

(Image 4)

$$S_{n,m} = T_{2n,m} \quad \text{(for an even field) (7)}$$

$$\left.\begin{aligned} S_{n,2m} &= T_{2n+1,2m} \\ S_{n,2m+1} &= T_{2n-1,2m+1} \end{aligned}\right\} \text{(for an odd field) (8)}$$

EXAMPLE 2

Utilizing the present invention, an interlaced image information display having display lines whose number is twice the number of scanning electrodes can be performed. It is not necessary that the number of display lines of the image information is equal to the number of scanning electrodes. An appropriate format conversion enables a non-interlace (progressive) image information display having display lines more than scanning electrodes. Next, an example of the conversion from non-interlaced image information to interlaced image information.

$P_{n,m}$ denotes non-interlaced image information. $V_p$ denotes a vertical pitch of the image information, and Hp denotes a horizontal pitch. In addition, $V_d$ denotes one-half of a scanning electrode pitch of the PDP 1, and $H_d$ denotes a horizontal pitch.

If the image information is an analog signal, the image information can be obtained with any pitch in the horizontal direction. The following explanation is about the case where the position of the image information in the horizontal direction is defined in a digital signal. In the explanation of the conversion rule, indexes of pixels start from zero both in the vertical direction and in the horizontal direction. An edge of the pixel having the index of zero is assigned to the origin of coordinates.

A conversion in the horizontal direction is considered. The m-th pixel occupies the space position from $mH_d$ to $(m+1)H_d$ on the display surface. The value of display is an average value of pixels of the image information within the above-mentioned range. Concerning a pixel whose pixel area is not completely in the range, the value is calculated by prorating. $P'_{n,m}$ denotes image information after converting the format only in the horizontal direction. The conversion rule is as following equation.

(Image 5)

$$P'_{n,m} = \frac{1}{\xi_H}\left\{P_{n,\alpha}(\alpha - \xi_H m) + P_{n,\beta}(\xi_H(m+1) - \beta) + \sum_{k=\alpha}^{\beta-1} P_{n,k}\right\} \quad (9)$$

where $$\left.\begin{aligned} \xi_H &= \frac{H_d}{H_p} \\ \alpha &= [\xi_H m] \\ \beta &= [\xi_H(m+1)] \end{aligned}\right\} \quad (10)$$

The expression [x] in the equation (10) represents the maximum integer less than or equal to x. The sum (sigma) in the equation (9) is zero when $\beta-1<\alpha$.

The format conversion in the vertical direction is performed in the same way according to the following equations.

(Image 6)

$$T_{n,m} = \frac{1}{\xi_V}\left\{P'_{\gamma,m}(\gamma - \xi_V n) + P'_{\delta,m}(\xi_V(n+1) - \delta) + \sum_{k=\gamma}^{\delta-1} P'_{k,m}\right\} \quad (11)$$

where $$\left.\begin{aligned} \xi_V &= \frac{V_d}{V_p} \\ \gamma &= [\xi_V n] \\ \delta &= [\xi_V(n+1)] \end{aligned}\right\} \quad (12)$$

The sum (sigma) in the equation (11) is zero when $\delta-1<\gamma$.

Using the image information $T_{n,m}$ derived by the equation (11), the interlaced display is performed in accordance with the equations (1)–(4).

The data conversion means are not limited to means that generate the data $C_{n,m}$ of the cell directly from the input image data $P_{n,m}$. Means for generating the interlaced signal $T_{n,m}$ from the image data $P_{n,m}$ can be separated from means for generating the data $C_{n,m}$ from the interlaced signal. Such a separation facilitates support of various signals only by changing the means for generating the interlaced signal.

EXAMPLE 3

In Example 2, the method of converting an image signal defined in the general equation into an interlaced signal is explained. The conversion of a signal is usually performed between the formats in which the pixel pitches are defined by a simple integer ratio. In Example 3, a conversion rule in the case where the pixel pitches are defined by an integer ratio will be explained.

The following relationship is assumed.

(Image 1)

$$\chi_{Hp}H_p=\chi_{Hd}H_d$$

$$\chi_{Vp}V_p=\chi_{Vd}V_d \tag{13}$$

(where, χHP, χHd, χVp and χVd are integers.)

The position relationships of pixels of two formats are identical in the period of $\chi_{Hp}V_p$ for the horizontal direction and are identical in the period of $\chi_{Vp}V_p$ for the vertical direction. Therefore, the conversion rule should be considered within these periods.

Figure 8A:
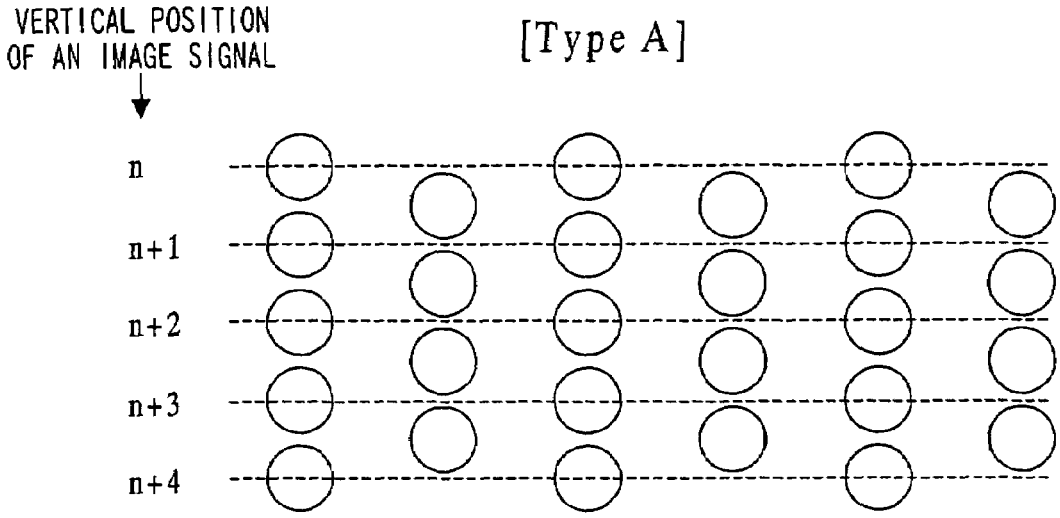
FIGS. 8A and 8B show relationships of positions between the input image signal and the cell.
Figure 8B:
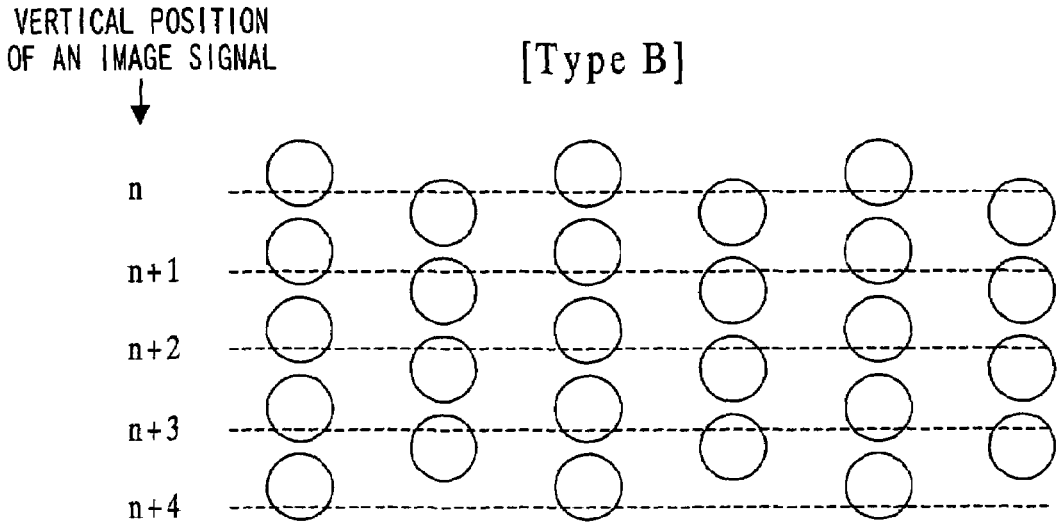

There are two cases concerning the period boundary. Type A is the case where the period boundary is at the edge of the cell as shown in FIG. 8A, while Type B is the case where the period boundary is at the center of the cell as shown in FIG. 8B. Therefore, four combinations of conversion rules are considered. However, the edges of the image areas of two formats are not completely identical except for the conversion from Type A into Type A. Therefore, a special process is necessary at the edge portion for the conversion, resulting in an excess job. Accordingly, the conversion from Type A to Type A is practical. The conversion rule in this case is the same as in Example 2.

The practical conversion that is the most important at the present time is the conversion from a 1280×720 non-interlaced signal that is a standard of a digital TV into a 1920×1080 interlaced signal. The pixel pitch is three to two. The concrete conversion rule is defined by the following equation.

(Image 8)

$$\left.\begin{aligned} P'_{n,3m} &= P_{n,2m} \\ P'_{n,3m+1} &= \frac{1}{2}P_{n,2m} + \frac{1}{2}P_{n,2m+1} \\ P'_{n,3m+2} &= P_{n,2m+1} \end{aligned}\right\} \tag{14}$$

$$\left.\begin{aligned} T_{3n,m} &= P'_{2n,m} \\ T_{3n+1,m} &= \frac{1}{2}P'_{2n,m} + \frac{1}{2}P'_{2n+1,m} \\ T_{3n+2,m} &= P'_{2n+1,m} \end{aligned}\right\} \tag{15}$$

Therefore, 540 of scanning electrodes enable displaying an interlaced image having 1080 lines and a non-interlaced image having 720 lines.

EXAMPLE 4

When displaying a non-interlaced image having display lines whose number is the same as the number of scanning electrodes, unevenness of the display lines that is unique to the delta arrangement becomes conspicuous if the combination of cells of the display line is fixed. In order to avoid this problem, the non-interlaced image is converted into an interlaced image having the number of lines twice the number of scanning electrodes, so as to perform the interlaced display.

$P_{n,m}$ denotes the image information of the non-interlace. The pitch of the vertical direction is the same as the pitch of the scanning electrodes. The image information is converted into the interlaced image information $T_{n,m}$ in which the number of lines is doubled.

(Image 9)

$$\left.\begin{aligned} T_{2n,m} &= P_{n,m} \\ T_{2n+1,m} &= P_{n,m} \end{aligned}\right\} \tag{16}$$

In this case, the following equations are satisfied in all cells without depending on the light emission color red, green or blue.

(Image 10)

$$\left.\begin{aligned} C_{2n,m} &= P_{n,m} \\ C_{2n+1,m} &= P_{n,m} \end{aligned}\right\}\text{(for an even field)} \tag{17}$$

$$\left.\begin{aligned} C_{2n,m} &= P_{n-1,m} \\ C_{2n+1,m} &= P_{n,m} \end{aligned}\right\}\text{(for an odd field)} \tag{18}$$

EXAMPLE 5

There are some methods for making the unevenness of the display lines that is unique to the delta arrangement inconspicuous. One of the methods is to distribute the luminance value of the pixel of the image data to plural cells considering the cell position of the display surface.

If the number of horizontal lines of the input image (the image signal) is the same as the number of the scanning electrodes, the luminance of each cell is determined as follows.

Figure 6:
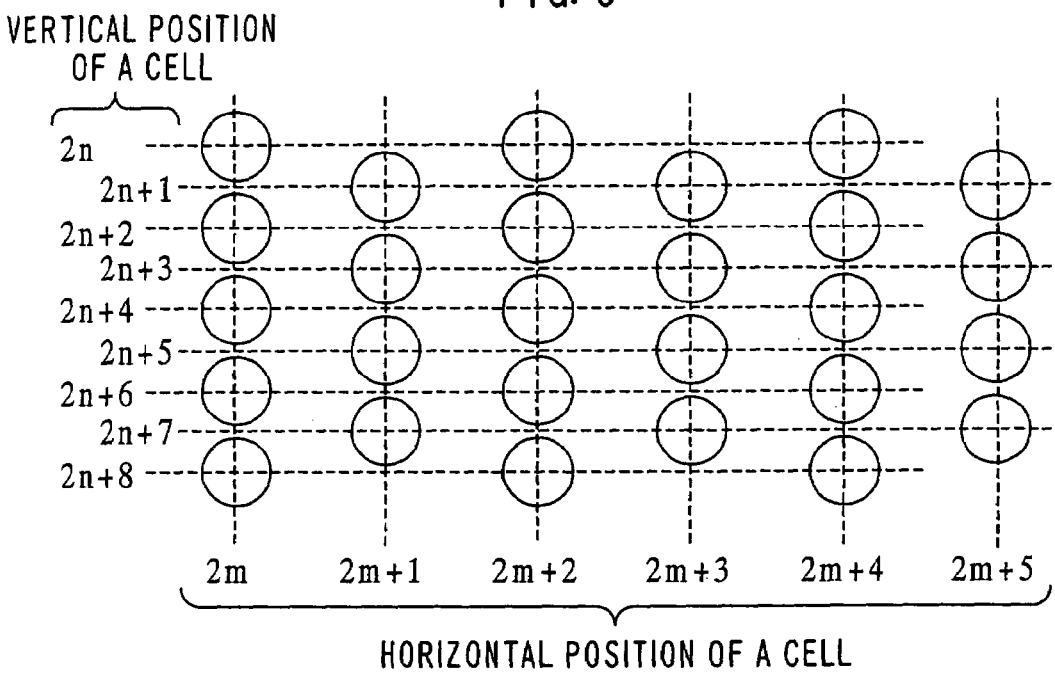
FIG. 6 shows how to number the cell whose light emission color is red or blue.
Figure 7:
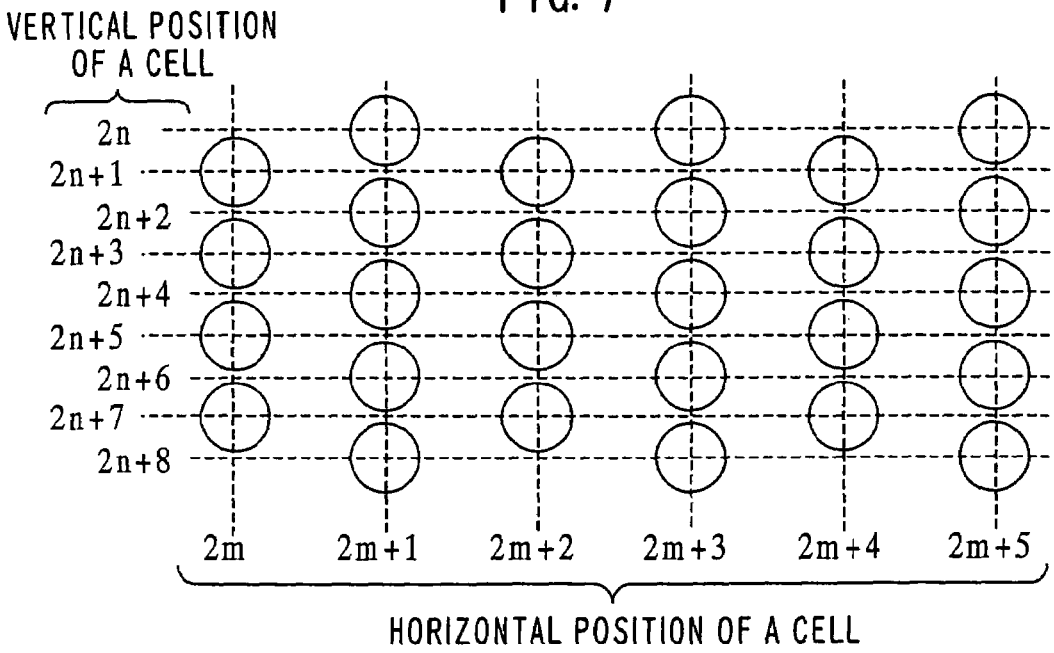
FIG. 7 shows how to number the cell whose light emission color is green.

In the same way as the above-mnentioned examples 1–4, the gradation level of a certain cell is denoted by $C_{n,m}$. The suffix "n" indicates the vertical position, and the suffix "m" indicates the horizontal position as shown in FIGS. 6 and 7. The image signal corresponding to the cell of the noted color is denoted by $T_{n,m}$.

Referring to FIGS. 8A and 8B, the vertical position of the horizontal line of the image signal is considered as Type A or Type B from the viewpoint of symmetry. In Type A, vertical position is the same as the cell. In type B, the vertical position is the center position between cells.

The relationship between the display luminance of the cell and the image data in Type A is defined by the following equations.

(Image 11)

$$\left.\begin{aligned} C_{2n,2m} &= T_{n,2m} \\ C_{2n+1,2m+1} &= \frac{1}{2}T_{n,2m+1} + \frac{1}{2}T_{n+1,2m+1} \end{aligned}\right\}\text{(red and blue cells)} \tag{19}$$

$$\left.\begin{aligned} C_{2n,2m+1} &= T_{n,2m+1} \\ C_{2n+1,2m} &= \frac{1}{2}T_{n,2m} + \frac{1}{2}T_{n+1,2m} \end{aligned}\right\}\text{(green cell)} \tag{20}$$

The relationship between the display luminance of the cell and the image data in Type B is defined by the following equations.

(Image 12)

-continued $$\left.\begin{aligned} C_{2n,2m} &= \frac{1}{4}T_{n-1,2m} + \frac{3}{4}T_{n,2m} \\ C_{2n+1,2m+1} &= \frac{3}{4}T_{n,2m+1} + \frac{1}{4}T_{n+1,2m+1} \end{aligned}\right\} \text{(red and blue cells)} \quad (21)$$

$$\left.\begin{aligned} C_{2n,2m+1} &= \frac{1}{4}T_{n-1,2m+1} + \frac{3}{4}T_{n,2m+1} \\ C_{2n+1,2m} &= \frac{3}{4}T_{n,2m} + \frac{1}{4}T_{n+1,2m} \end{aligned}\right\} \text{(green cell)} \quad (22)$$

$$\left.\begin{aligned} C_{2n,2m+1} &= \frac{1}{4}T_{n-1,2m+1} + \frac{3}{4}T_{n,2m+1} \\ C_{2n+1,2m} &= \frac{3}{4}T_{n,2m} + \frac{1}{4}T_{n+1,2m} \end{aligned}\right\} \text{(green cell)} \quad (22)$$

When the vertical positions of the cells that can be designated by the n-th scanning electrode are denoted by 2n and 2n+1, the relationship between the image data $S_{n,m}$ of the cell and the gradation level $C_{n,m}$ corresponding to the scanning electrode is defined by the following equations.

(Image 13)

$$\left.\begin{aligned} S_{n,2m} &= C_{2n,2m} \\ S_{n,2m+1} &= C_{2n+1,2m+1} \end{aligned}\right\} \text{(red and blue cells)} \quad (23)$$

$$\left.\begin{aligned} S_{n,2m} &= C_{2n+1,2m} \\ S_{n,2m+1} &= C_{2n,2m+1} \end{aligned}\right\} \text{(green cell)} \quad (24)$$

By performing the display in accordance with the above-mentioned relationships, the display that is faithful to the position information of the image data can be realized, so that the display quality of the horizontal line can be improved.

EXAMPLE 6

Figure 9:
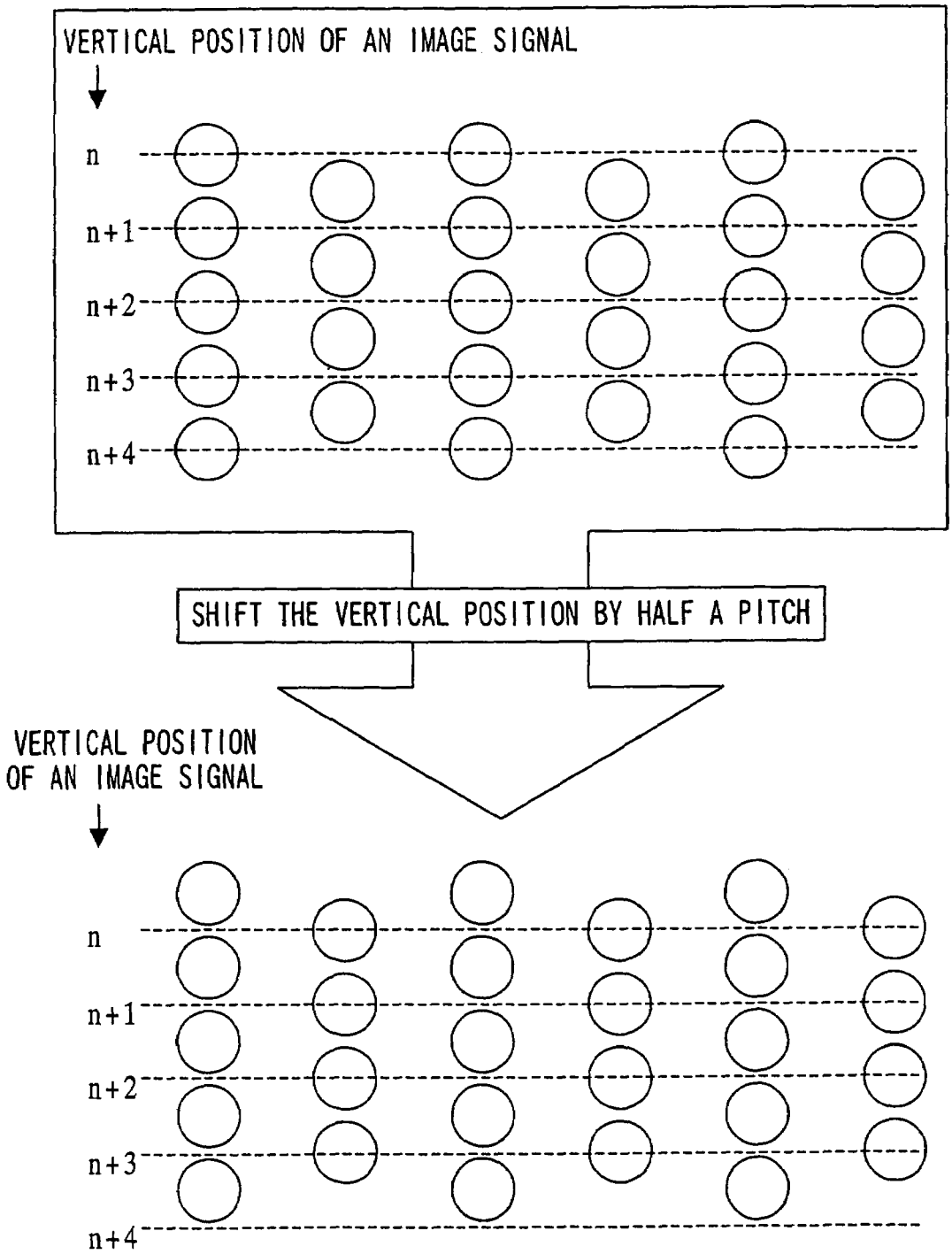
FIG. 9 shows an example of changing the relationship of positions between the input image signal and the cell.

In the above-mentioned Example 5, the vertical position of the horizontal line of the input image can be shifted by a half pitch of the scanning electrode pitch. Application of this method to Type A is shown in FIG. 9. The relationship between the image signal and the display luminance of the cell when the vertical position is shifted is defined by the following equations.

In the case of Type A, the following equations are derived.

(Image 14)

$$\left.\begin{aligned} C_{2n,2m} &= \frac{1}{2}T_{n-1,2m} + \frac{1}{2}T_{n,2m} \\ C_{2n+1,2m+1} &= T_{n,2m+1} \end{aligned}\right\} \text{(red and blue cells)} \quad (25)$$

$$\left.\begin{aligned} C_{2n,2m+1} &= \frac{1}{2}T_{n-1,2m+1} + \frac{1}{2}T_{n,2m+1} \\ C_{2n+1,2m} &= T_{n,2m} \end{aligned}\right\} \text{(green cell)} \quad (26)$$

In the case of Type B, the following equations are derived.

(Image 15)

$$\left.\begin{aligned} C_{2n,2m} &= \frac{3}{4}T_{n,2m} + \frac{1}{4}T_{n+1,2m} \\ C_{2n+1,2m+1} &= T_{n,2m+1} \end{aligned}\right\} \text{(red and blue cells)} \quad (27)$$

$$\left.\begin{aligned} C_{2n,2m+1} &= \frac{3}{4}T_{n,2m+1} + \frac{1}{4}T_{n+1,2m+1} \\ C_{2n+1,2m} &= \frac{1}{4}T_{n,2m} + \frac{3}{4}T_{n+1,2m} \end{aligned}\right\} \text{(green cell)} \quad (28)$$

The image displayed by the relationship of equations (19)–(22) is shifted from the image displayed by the relationship of equations (25)–(28) by half a scanning electrode pitch. Therefore, two kinds of relationships are assigned to odd fields and even fields, so that an interlaced display of the image information having horizontal lines twice the number of the scanning electrode.

$T_{n,m}$ denotes information of an interlaced image. $T'_{2n,m}$ denotes information of an even field, and $T'_{2n,m}$ denotes information of an odd field. The relationship between the image signal and the display luminance of a cell is defined by the following equations.

The relationship in the even field of Type A is defined by the following equations.

(Image 16)

$$\left.\begin{aligned} C_{2n,2m} &= T'_{2n,2m} \\ C_{2n+1,2m+1} &= \frac{1}{2}T'_{2n,2m+1} + \frac{1}{2}T'_{2n+2,2m+1} \end{aligned}\right\} \text{(red and blue cells)} \quad (29)$$

$$\left.\begin{aligned} C_{2n,2m+1} &= T'_{2n,2m+1} \\ C_{2n+1,2m} &= \frac{1}{2}T'_{2n,2m} + \frac{1}{2}T'_{2n+2,2m} \end{aligned}\right\} \text{(green cell)} \quad (30)$$

The relationship in the odd field of Type A is defined by the following equations.

(Image 17)

$$\left.\begin{aligned} C_{2n,2m} &= \frac{1}{2}T'_{2n-1,2m} + \frac{1}{2}T'_{2n+1,2m} \\ C_{2n+1,2m+1} &= T'_{2n+1,2m+1} \end{aligned}\right\} \text{(red and blue cells)} \quad (31)$$

$$\left.\begin{aligned} C_{2n,2m+1} &= \frac{1}{2}T'_{2n-1,2m+1} + \frac{1}{2}T'_{2n+1,2m+1} \\ C_{2n+1,2m} &= T'_{2n+1,2m} \end{aligned}\right\} \text{(green cell)} \quad (32)$$

The relationship in the even field of Type B is defined by the following equations.

(Image 18)

-continued $$\left.\begin{aligned} C_{2n,2m} &= \frac{1}{4}T'_{2n-2,2m} + \frac{3}{4}T'_{2n,2m} \\ C_{2n+1,2m+1} &= \frac{3}{4}T'_{2n,2m+1} + \frac{1}{4}T'_{2n+2,2m+1} \end{aligned}\right\} \text{(red and blue cells)} \quad (33)$$

$$\left.\begin{aligned} C_{2n,2m+1} &= \frac{1}{4}T'_{2n-2,2m+1} + \frac{3}{4}T'_{2n,2m+1} \\ C_{2n+1,2m} &= \frac{3}{4}T'_{2n,2m} + \frac{1}{4}T'_{2n+2,2m} \end{aligned}\right\} \text{(green cell)} \quad (34)$$

The relationship in the odd field of Type B is defined by the following equations.

(Image 19)

$$\left.\begin{aligned} C_{2n,2m} &= \frac{3}{4}T'_{2n-1,2m} + \frac{1}{4}T'_{2n+1,2m} \\ C_{2n+1,2m+1} &= \frac{1}{4}T'_{2n-1,2m+1} + \frac{3}{4}T'_{2n+1,2m+1} \end{aligned}\right\} \text{(red and blue cells)} \quad (35)$$

$$\left.\begin{aligned} C_{2n,2m+1} &= \frac{3}{4}T'_{2n-1,2m+1} + \frac{3}{4}T'_{2n+1,2m+1} \\ C_{2n+1,2m} &= \frac{1}{4}T'_{2n-1,2m} + \frac{3}{4}T'_{2n+1,2m} \end{aligned}\right\} \text{(green cell)} \quad (36)$$

EXAMPLE 7

Although the distribution of the pixel information is performed only in the vertical direction in Examples 5 and 6, it is desirable to perform the distribution also in the horizontal direction for more accuracy.

Figure 10:
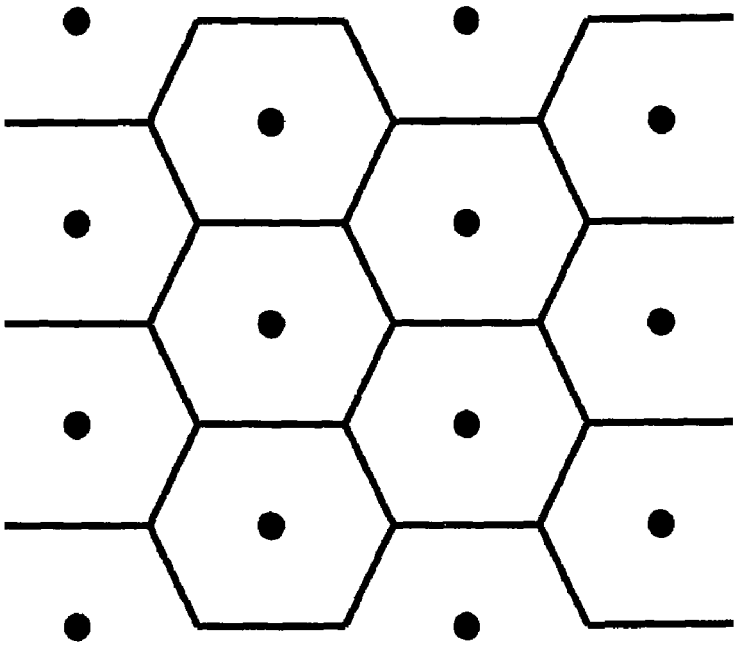
FIG. 10 shows a unit display area (a cell) and the display center thereof.

FIG. 10 shows a unit display area of a certain color and the display center thereof. The display center indicated by a dot in FIG. 10 is the cell center. The unit display area means an image area to be displayed by the cell. More specifically, the area is divided so that a certain position on the image is included in the unit display area to which the closest display center belongs. A hexagonal area surrounding the display center in FIG. 10 is the unit display area. The border line passes the center of the line that connects display centers facing each other with respect to the border line and is perpendicular to the line.

Figure 11:
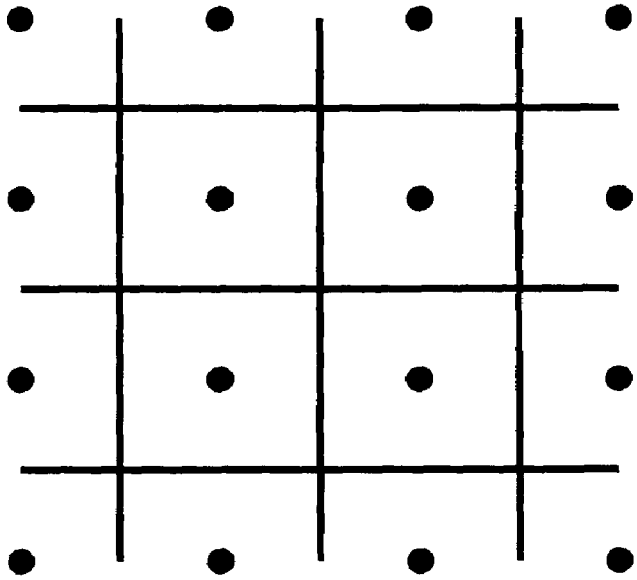
FIG. 11 shows a unit information area (a pixel) and the center thereof.

The relationship between the information center and the unit information area is shown in FIG. 11. Herein, the "unit information area" means the area where the image is expressed with discrete image information. The area is usually divided with rectangles. The information center signifies a position of the discrete information. The information in a unit area of the image is assigned to the center of the information.

The individual image information unit represents image information of the unit information area. Therefore, the distribution of the information should be performed in accordance with the area ratio where the individual unit display area is overlaid on the noted unit information area.

Figure 12A:
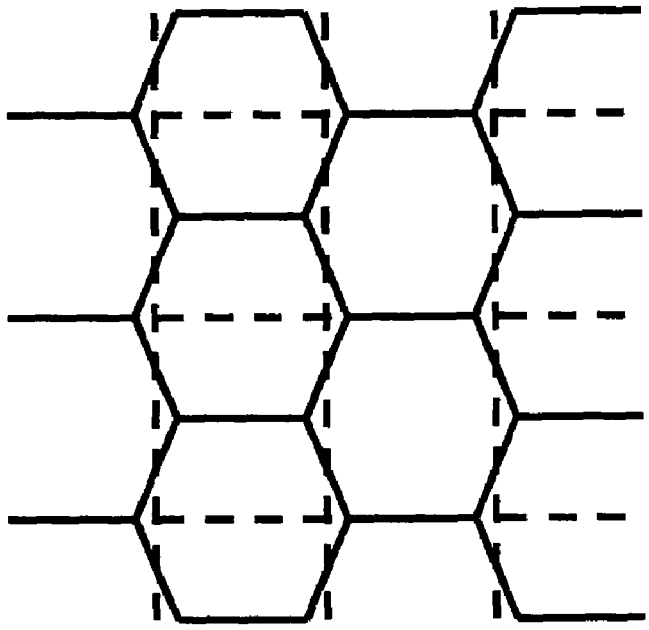
FIGS. 12A and 12B show the relationships between the unit information area and the unit display area.
Figure 12B:
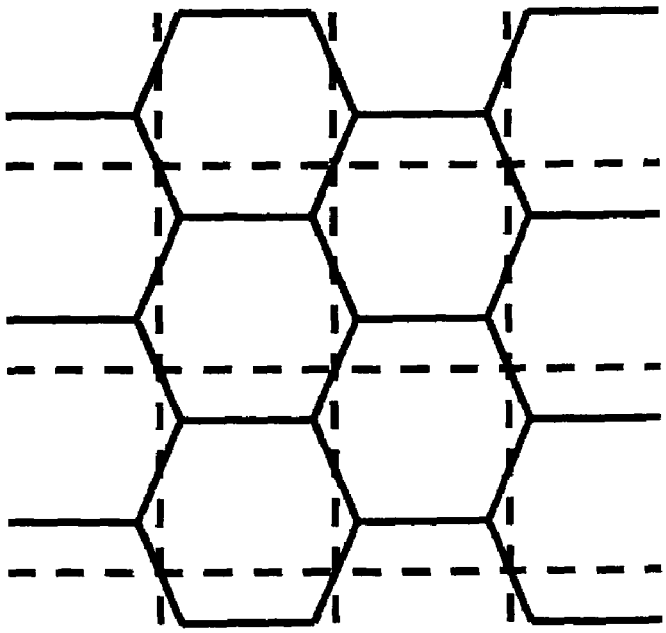

The type of overlay of the unit information area with the unit display area in Type A is shown in FIG. 12A, and that in Type B is shown in FIG. 12B. Solid lines indicate boundaries between unit display areas, and broken lines indicate boundaries between unit information areas.

When displaying image information having horizontal lines whose number is the same as the number of scanning electrodes, the relationship between the display luminance of the cell and the image data is defined by the following equations.

The relationship in Type A is defined by the following equations.

(Image 20) (37)

$$\left.\begin{aligned} C_{2n,2m} &= \frac{1}{32}T_{n,2m-1} + \frac{15}{16}T_{n,2m} + \frac{1}{32}T_{n,2m+1} \\ C_{2n+1,2m+1} &= \frac{1}{64}T_{n,2m} + \frac{15}{32}T_{n,2m+1} + \frac{1}{64}T_{n,2m+2} + \frac{1}{64}T_{n+1,2m} + \frac{15}{32}T_{n+1,2m+1} + \frac{1}{64}T_{n+1,2m+2} \end{aligned}\right\}$$

(red and blue cells)

$$\left.\begin{aligned} C_{2n,2m+1} &= \frac{1}{32}T_{n,2m} + \frac{15}{16}T_{n,2m+1} + \frac{1}{32}T_{n,2m+2} \\ C_{2n+1,2m} &= \frac{1}{64}T_{n,2m-1} + \frac{15}{32}T_{n,2m} + \frac{1}{64}T_{n,2m+1} + \frac{1}{64}T_{n+1,2m-1} + \frac{15}{32}T_{n+1,2m} + \frac{1}{64}T_{n+1,2m+1} \end{aligned}\right\} \quad (38)$$

(green cell)

The relationship in Type A including a shift of a half pitch is defined by the following equations.

(Image 21) (39)

$$\left.\begin{aligned} C_{2n,2m} &= \frac{1}{64}T_{n-1,2m-1} + \frac{15}{32}T_{n-1,2m} + \frac{1}{64}T_{n-1,2m+1} + \frac{1}{64}T_{n,2m-1} + \frac{15}{32}T_{n,2m} + \frac{1}{64}T_{n,2m+1} \\ C_{2n+1,2m+1} &= \frac{1}{32}T_{n,2m} + \frac{15}{16}T_{n,2m+1} + \frac{1}{32}T_{n,2m+2} \end{aligned}\right\}$$

(red and blue cells)

-continued $$\left.\begin{aligned} C_{2n,m+1} &= \frac{1}{64}T_{n-1,2m} + \frac{15}{32}T_{n-1,2m+1} + \frac{1}{64}T_{n-1,2m+2} + \frac{1}{64}T_{n,2m} + \frac{15}{32}T_{n,2m+1} + \frac{1}{64}T_{n,2m+2} \\ C_{2n+1,2m} &= \frac{1}{32}T_{n,2m-1} + \frac{15}{16}T_{n,2m} + \frac{1}{32}T_{n,2m+1} \end{aligned}\right\}\text{(green cell)} \tag{40}$$

The relationship in Type B is defined by the following equations.

(*Image* 22)

$$\left.\begin{aligned} C_{2n,2m} &= \frac{7}{32}T_{n-1,2m} + \frac{1}{32}T_{n,2m-1} + \frac{23}{32}T_{n,2m} + \frac{1}{32}T_{n,2m+1} \\ C_{2n+1,2m+1} &= \frac{1}{32}T_{n,2m} + \frac{23}{32}T_{n,2m+1} + \frac{1}{32}T_{n,2m+2} + \frac{7}{32}T_{n+1,2m+1} \end{aligned}\right\}\text{(red and blue cells)} \tag{41}$$

$$\left.\begin{aligned} C_{2n,2m+1} &= \frac{7}{32}T_{n-1,2m+1} + \frac{1}{32}T_{n,2m} + \frac{23}{32}T_{n,2m+1} + \frac{1}{32}T_{n,2m+2} \\ C_{2n+1,2m} &= \frac{1}{32}T_{n,2m-1} + \frac{23}{32}T_{n,2m} + \frac{1}{32}T_{n,2m+1} + \frac{7}{32}T_{n+1,2m} \end{aligned}\right\}\text{(green cell)} \tag{42}$$

The relationship in Type B including a shift of a half pitch is defined by the following equations.

(Image 23 ) (43)

$$\left.\begin{aligned} C_{2n,2m} &= \frac{1}{32}T_{n,2m-1} + \frac{23}{32}T_{n,2m} + \frac{1}{32}T_{n,2m+1} + \frac{7}{32}T_{n+1,2m} \\ C_{2n+1,2m+1} &= \frac{7}{32}T_{n,2m+1} + \frac{1}{32}T_{n+1,2m} + \frac{23}{32}T_{n+1,2m+1} + \frac{1}{32}T_{n+1,2m+2} \end{aligned}\right\}$$

(red and blue cells )

-continued $$\left.\begin{aligned} C_{2n,2m+1} &= \frac{1}{32}T_{n,2m} + \frac{23}{32}T_{n,2m+1} + \frac{1}{32}T_{n,2m+2} + \frac{7}{32}T_{n+1,2m+1} \\ C_{2n+1,2m} &= \frac{7}{32}T_{n,2m} + \frac{1}{32}T_{n+1,2m-1} + \frac{23}{32}T_{n+1,2m} + \frac{1}{32}T_{n+1,2m+1} \end{aligned}\right\}\text{(green cell)} \tag{44}$$

Next, the relationship between the display luminance of a cell and image data will be shown when the interlaced display of image information having horizontal lines whose number is twice the number of scanning electrodes is performed. The relationship of an even field in Type A is defined by the following equations.

(Image 24 ) (45)

$$\left.\begin{aligned} C_{2n,2m} &= \frac{1}{32}T_{2n,2m-1} + \frac{15}{16}T_{2n,2m} + \frac{1}{32}T_{2n,2m+1} \\ C_{2n+1,2m+1} &= \frac{1}{64}T_{2n,2m} + \frac{15}{32}T'_{2n,2m+1} + \frac{1}{64}T_{2n,2m+2} + \frac{1}{64}T_{2n+2,2m} + \frac{15}{32}T'_{2n+2,2m+1} + \frac{1}{64}T'_{2n+2,2m+2} \end{aligned}\right\}$$

(red and blue cells )

$$\left.\begin{aligned} C_{2n,2m+1} &= \frac{1}{32}T'_{2n,2m} + \frac{15}{16}T'_{2n,2m+1} + \frac{1}{32}T'_{2n,2m+2} \\ C_{2n+1,2m} &= \frac{1}{64}T'_{2n,2m-1} + \frac{15}{32}T'_{2n,2m} + \frac{1}{64}T'_{2n,2m+1} + \frac{1}{64}T'_{2n+2,2m-1} + \frac{15}{32}T'_{2n+2,2m} + \frac{1}{64}T'_{2n+2,2m-1} \end{aligned}\right\}\text{(green cell)} \tag{46}$$

The relationship of an odd field in Type A is defined by the following equations.

(Image 25)

$$\left.\begin{aligned} C_{2n,2m} &= \frac{1}{64}T'_{2n-1,2m-1} + \frac{15}{32}T'_{2n-1,2m} + \frac{1}{64}T'_{2n-1,2m+1} + \frac{1}{64}T'_{2n+1,2m-1} + \frac{15}{32}T'_{2n+1,2m} + \frac{1}{64}T'_{2n+1,2m+1} \\ C_{2n+1,2m+1} &= \frac{1}{32}T'_{2n+1,2m} + \frac{15}{16}T'_{2n+1,2m+1} + \frac{1}{32}T'_{2n+1,2m+2} \end{aligned}\right\} \quad \text{(red and blue cells)} \tag{47}$$

$$\left.\begin{aligned} C_{2n,2m+1} &= \frac{1}{64}T'_{2n-1,2m} + \frac{15}{32}T'_{2n-1,2m+1} + \frac{1}{64}T'_{2n-1,2m+2} + \frac{1}{64}T'_{2n+1,2m} + \frac{15}{32}T'_{2n+1,2m+1} + \frac{1}{64}T'_{2n+1,2m+2} \\ C_{2n+1,2m} &= \frac{1}{32}T'_{2n+1,2m-1} + \frac{15}{16}T'_{2n+1,2m} + \frac{1}{32}T'_{2n+1,2m+1} \end{aligned}\right\} \text{(green cell)} \tag{48}$$

The relationship of an even field in Type B is defined by the following equations.

(Image 26)

$$\left.\begin{aligned} C_{2n,2m} &= \frac{7}{32}T'_{2n-2,2m} + \frac{1}{32}T'_{2n,2m-1} + \frac{23}{32}T'_{2n,2m} + \frac{1}{32}T'_{2n,2m+1} \\ C_{2n+1,2m+1} &= \frac{1}{32}T'_{2n,2m} + \frac{23}{32}T'_{2n,2m+1} + \frac{1}{32}T'_{2n,2m+2} + \frac{7}{32}T'_{2n+2,2m+1} \end{aligned}\right\} \quad \text{(red and blue cells)} \tag{49}$$

$$\left.\begin{aligned} C_{2n,2m+1} &= \frac{7}{32}T'_{2n-2,2m+1} + \frac{1}{32}T'_{2n,2m} + \frac{23}{32}T'_{2n,2m+1} + \frac{1}{32}T'_{2n,2m+2} \\ C_{2n+1,2m} &= \frac{1}{32}T'_{2n,2m-1} + \frac{23}{32}T'_{2n,2m} + \frac{1}{32}T'_{2n,2m+1} + \frac{7}{32}T'_{2n+2,2m} \end{aligned}\right\} \text{(green cell)} \tag{50}$$

The relationship of an odd field in Type B is defined by the following equations.

(Image 27)

$$\left.\begin{aligned} C_{2n,2m} &= \frac{1}{32}T_{2n-1,2m-1} + \frac{23}{32}T_{2n-1,2m} + \frac{1}{32}T_{2n-1,2m+1} + \frac{7}{32}T_{2n+1,2m} \\ C_{2n+1,2m+1} &= \frac{7}{32}T_{2n-1,2m+1} + \frac{1}{32}T_{2n+1,2m} + \frac{23}{32}T_{2n+1,2m+1} + \frac{1}{32}T_{2n+1,2m+2} \end{aligned}\right\} \text{(red and blue cells)} \tag{51}$$

$$\left.\begin{aligned} C_{2n,2m+1} &= \frac{1}{32}T_{2n-1,2m} + \frac{23}{32}T_{2n-1,2m+1} + \frac{1}{32}T_{2n-1,2m+2} + \frac{7}{32}T_{2n+1,2m+1} \\ C_{2n+1,2m} &= \frac{7}{32}T_{2n-1,2m} + \frac{1}{32}T_{2n+1,2m} + \frac{23}{32}T_{2n+1,2m} + \frac{1}{32}T_{2n+1,2m+1} \end{aligned}\right\} \text{(green cell)} \tag{52}$$

Figure 13:
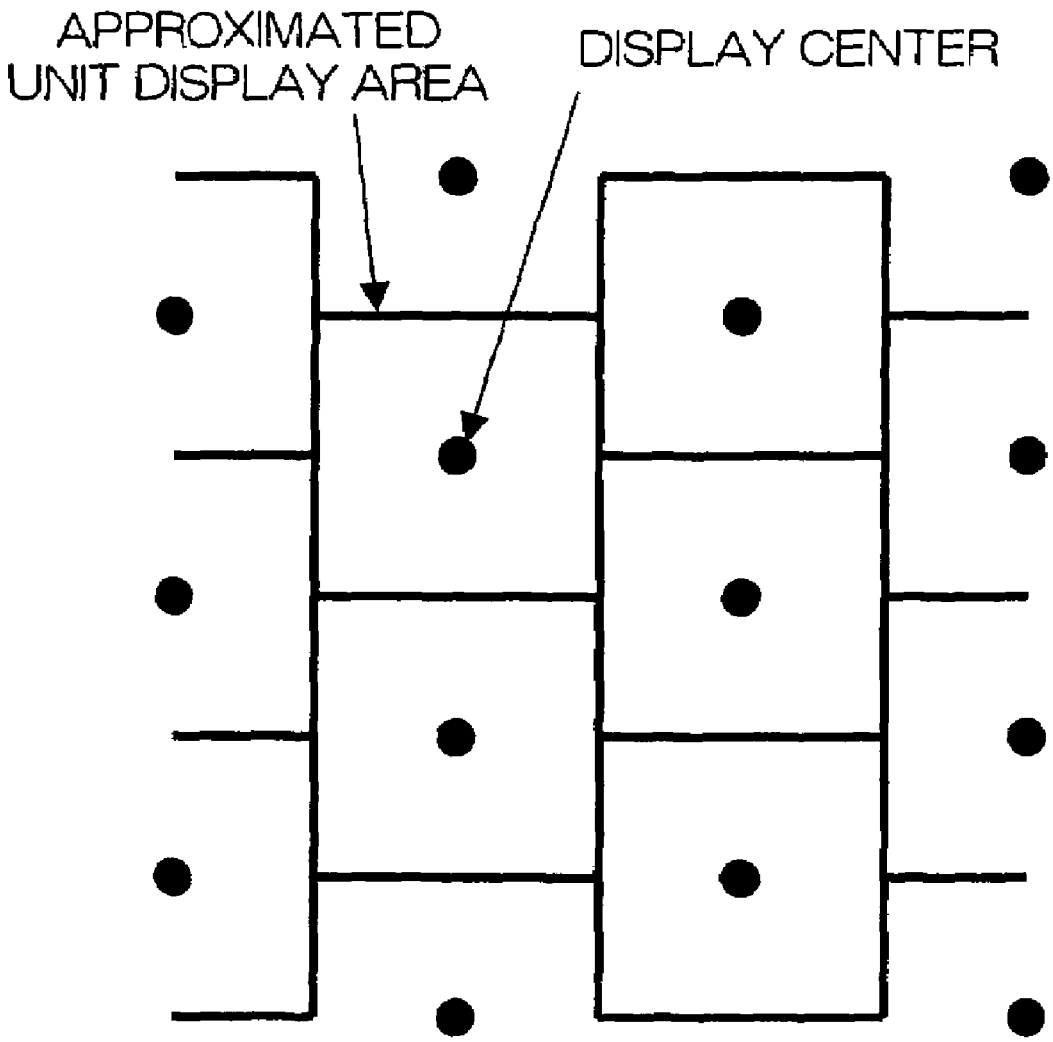
FIG. 13 shows an approximate unit display area and the display center thereof.

As explained above, an image can be displayed more faithfully concerning position information. It is possible to apply the method of distributing image information to each cell in accordance with the overlaying area ratio of the unit information area of each color with the unit display area to the case where the image information has any pitch in the horizontal direction as well as in the vertical direction. Furthermore, in the case of Example 5 or 6, it can be considered that the image information is divided by the overlaying area ratio of the unit information area of each color with the unit display area after making approximation of the unit display area as shown in FIG. 13.

The present invention can be applied to any display devices other than a PDP if the cell arrangement is similar. The display is not limited to a color display, but can be a monochromatic display using a device in which all cells emit light of the same color.

According to the present invention, a high definition display can be realized in which the display line pitch is smaller than the cell arrangement pitch in the column direction in the display surface having display lines of cells arranged zigzag.

In addition, the position information of an image can be reproduced more faithfully.

Furthermore, a high definition display can be realized that has a large aperture ratio of a cell, high luminance, low possibility of cross talk in the column direction and little display fluctuations, and in which the display line pitch is smaller than the cell arrangement pitch in the column direction.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A method of displaying an image, comprising:

using a display device having a display surface including plural cell columns, each of which is a set of cells having a same light emission color, the display device having cells arranged in a structure in which cell positions in a column direction are shifted from each other between neighboring cell columns; and performing an interlaced display by changing a combination of cells of a display line that is perpendicular to the column direction in every field between the neighboring cell columns of the same light emission color, wherein a display line pitch is smaller than a cell pitch in a column, the display line pitch being a measurement in a vertical direction from a center of one display line to a center of an adjoining display line and the cell pitch being a measurement in a vertical direction from a center of one cell to a center of an adjoining cell.

2. The method according to claim 1, further comprising determining luminance of each cell of the display surface by distributing a luminance value of each pixel of an input image to be displayed to cells corresponding to pixels in accordance with a cell position relationship between a virtual display surface having cells arranged corresponding to a pixel arrangement of the input image and the display surface.

3. A display apparatus comprising:

a display device having a display surface including plural cell columns, each of which is a set of cells having a same light emission color, the display device having cells arranged in a structure in which cell positions in a column direction are shifted from each other between neighboring cell columns; and a driving circuit for performing an interlaced display by changing a combination of cells of a display line that is perpendicular to the column direction in every field between the neighboring cell columns of the same light emission color in every field, wherein a display line pitch being smaller than a cell pitch in a column, the display line pitch is a measurement in a vertical direction from a center of one display line to a center of an adjoining display line and the cell pitch being a measurement in a vertical direction from a center of one cell to a center of an adjoining cell.

4. The display apparatus according to claim 3, wherein the cells are arranged at a constant pitch in each cell column and the shift quantity of the cell position in the column direction between the neighboring cell columns of the same light emission color is a half of the cell pitch.

5. The display apparatus according to claim 3, wherein luminance of each cell of the display surface is determined by distributing a luminance value of each pixel of an input image to be displayed to cells corresponding to pixels in accordance with the cell position relationship between a virtual display surface having cells arranged corresponding to a pixel arrangement of the input image and the display surface.

6. The display apparatus according to claim 3, wherein the all cells within the display surface have the same light emission color.

7. The display apparatus according to claim 3, wherein the display surface includes three kinds of cell columns having different light emission colors, and a color arrangement has a pattern in which three colors are repeated in a constant order.

8. The display apparatus according to claim 3, wherein an interlaced image to be displayed is inputted, and the direction of the display line is the direction of a scanning line of the interlaced image.

9. The display apparatus according to claim 3, wherein a non-interlaced image to be displayed is inputted, and the non-interlaced image is converted into an interlaced image to be displayed.

10. The display apparatus according to claim 9, wherein gradation data of each pixel of the interlaced image are generated from the non-interlaced image data.

11. The display apparatus according to claim 3, wherein the display device is a plasma display panel.

12. The display apparatus according to claim 3, wherein the display device is a plasma display panel having an inner structure including a partition for dividing a discharge space for each cell column, the discharge space is continuous over the entire length of the display surface in each cell column, and wide portions and narrow portions are arranged alternately so that the narrow portion is located at the boundary position between cells.

13. The display apparatus according to claim 12, wherein the display device has a plurality of scanning electrodes arranged to straddle over all cell columns for selecting one cell in each cell column of each field.

14. A display apparatus comprising:

a display device having a display surface including plural cell columns, each of which is a set of cells having a same light emission color, the display device having cells arranged in a structure in which cell positions in a column direction are shifted from each other between neighboring cell columns; and a driving circuit for performing an interlaced display by changing a combination of cells of a display line having a display line pitch that is smaller than a cell pitch in a column, wherein the display line is perpendicular to the column direction in every field between the neighboring cell columns of the same light emission color in every field, and wherein a number of display lines utilized is twice a number of scanning electrodes utilized, the display line pitch being a measurement in a vertical direction from a center of one display line to a center of an adjoining display line and the cell pitch being a measurement in a vertical direction from a center of one cell to a center of an adjoining cell.

15. A display apparatus comprising:

a display device having a display surface including plural cell columns, each of which is a set of cells having a same light emission color, the display device having cells arranged in a structure in which the cells are arranged at a constant cell pitch in each cell column, and cell positions in a column direction are shifted from each other between neighboring cell columns by half of the constant cell pitch; and a driving circuit for performing an interlaced display by changing a combination of cells of a display line having a display line pitch that is smaller than the cell pitch in a column, wherein the display line is perpendicular to the column direction in every field between the neighboring cell columns of the same light emission color in every field, and wherein a number of display lines utilized is twice a number of scanning electrodes utilized, the display line pitch being a measurement in a vertical direction from a center of one display line to a center of an adjoining display line and the cell pitch being a measurement in a vertical direction from a center of one cell to a center of an adjoining cell.

* * * * *

UNITED STATES PATENT AND TRADEMARK OFFICE

CERTIFICATE OF CORRECTION

PATENT NO. : 7,050,021 B2
APPLICATION NO. : 09/778919
DATED : May 23, 2006
INVENTOR(S) : Yasunobu Hashimoto It is certified that error appears in the above-identified patent and that said Letters Patent is hereby corrected as shown below:

On Title Page item 56

First Page Column 2 (Other Publications) Line 1, change “et al.” to --et al.:--

First Page Column 2 (Other Publications) Line 3, after “Anaheim,” delete “May 6, vol.”.

Signed and Sealed this

Seventeenth Day of April, 2007

JON W. DUDAS
*Director of the United States Patent and Trademark Office*